US009815678B2

(12) United States Patent
Furberg et al.

(10) Patent No.: US 9,815,678 B2
(45) Date of Patent: Nov. 14, 2017

(54) DRINK DISPENSING SYSTEM AND METHOD THEREOF

(75) Inventors: Richard Furberg, Akersbega (SE); Andreas Aschan, Hagersten (SE); Daniel L. Johansson, Stockholm (SE); Ilan Cohen, Alvsjo (SE); Marco Coan, Tullinge (SE)

(73) Assignee: Aktiebolaget Electrolux, Stockholm (SE)

( * ) Notice: Subject to any disclaimer, the term of this patent is extended or adjusted under 35 U.S.C. 154(b) by 551 days.

(21) Appl. No.: 13/698,391

(22) PCT Filed: May 18, 2010

(86) PCT No.: PCT/EP2010/003003

§ 371 (c)(1),
(2), (4) Date: Feb. 4, 2013

(87) PCT Pub. No.: WO2011/144219

PCT Pub. Date: Nov. 24, 2011

(65) Prior Publication Data

US 2013/0233884 A1 Sep. 12, 2013

(51) Int. Cl.

| | |
|---|---|
| ***B67D 1/12*** | (2006.01) |
| ***B67D 1/00*** | (2006.01) |
| ***B67D 1/04*** | (2006.01) |
| ***B67D 1/08*** | (2006.01) |

(52) U.S. Cl.

CPC ..... *B67D 1/1202* (2013.01); *B67D 1/0003* (2013.01); *B67D 1/04* (2013.01); *B67D 1/0857* (2013.01); *B67D 1/12* (2013.01); *B67D 1/1247* (2013.01)

(58) Field of Classification Search

CPC ..... B67D 1/0003; B67D 1/04; B67D 1/0857; B67D 1/1202; B67D 1/1247; B67D 1/12; F04B 2203/0201; F04B 2203/0401; F04B 49/02; F04B 49/065; F04D 15/0236; F04D 15/0254

USPC ..... 222/1, 146.6, 63, 52; 417/1, 12, 44.11

See application file for complete search history.

(56) References Cited

U.S. PATENT DOCUMENTS

| | | | | |
|---|---|---|---|---|
| 4,940,164 | A | 7/1990 | Hancock et al. | |
| 5,855,120 | A | 1/1999 | Kim | |
| 6,577,089 | B1 * | 6/2003 | Piedl et al. | 318/432 |
| 6,712,342 | B2 * | 3/2004 | Bosko | 261/127 |
| 7,267,531 | B2 * | 9/2007 | Anderson et al. | 417/44.11 |

(Continued)

FOREIGN PATENT DOCUMENTS

| | | | |
|---|---|---|---|
| DE | 19833832 | 3/1999 | |
| DE | 19833832 A1 * | 3/1999 | B67D 1/0004 |

(Continued)

OTHER PUBLICATIONS

International Search Report for PCT/EP2010/003003, dated May 25, 2011, 2 pages.

*Primary Examiner* — Nicholas J Weiss
(74) *Attorney, Agent, or Firm* — Pearne & Gordon LLP

(57) ABSTRACT

An in-line drink dispensing system (1,16,17) for dispensing liquid such as water or other beverage. The system comprises a pump (6) in fluid connection with the system so that the pump can create a flow in the system and based on the current that the pump uses during operation a value can be determined and used for analyzing one or more statuses of the system.

17 Claims, 8 Drawing Sheets

(56) References Cited

U.S. PATENT DOCUMENTS

| | | | | |
|---|---|---|---|---|
| 8,167,168 | B2 * | 5/2012 | Reynolds | 222/1 |
| 8,441,222 | B2 * | 5/2013 | Manzarek et al. | 318/650 |
| 2006/0145651 | A1 * | 7/2006 | Sullivan | 318/727 |
| 2007/0128047 | A1 * | 6/2007 | Gonnella et al. | 417/2 |

FOREIGN PATENT DOCUMENTS

| | | |
|---|---|---|
| EP | 1579906 | 9/2005 |
| FR | 2861274 | 4/2005 |
| GB | 2449070 | 11/2008 |
| WO | 03037492 | 5/2003 |

* cited by examiner

DRINK DISPENSING SYSTEM AND METHOD THEREOF

FIELD OF THE INVENTION

The present invention relates to drink dispensing systems. In particular it relates to in-line drink dispensing systems. The drink dispensing system can either be built into an appliance such as a refrigerator, for home use or for commercial use, or be formed as a self contained unit.

BACKGROUND OF THE INVENTION

Drink dispensers are today a quite common feature within refrigerators, supplying customers with chilled and/or filtered water. Known drink dispenser systems can either have a main pipe connected directly to the inlet, or in some solutions the system is connected to a reservoir for supply of liquid such as water. Some of these systems may also be equipped with a cooling device in which the liquid can be chilled and stored, and at a later point in time being dispensed. Furthermore some systems also have a carbonating unit for adding carbon dioxide to the water. An example of such a prior art system for supplying of cooled and carbonated water or other beverage is disclosed in EP 1974802. EP1974802 discloses a cool drink dispenser having a main pipe connected to a supply source to receive a beverage, a metering valve connected to the main pipe to receive the beverage and designed to permit controlled outflow of the beverage from the main pipe into a container positioned temporarily beneath the metering valve, an in-line cooling unit located along the main pipe to cool the beverage flowing along a first portion of the main pipe and an in-line gas-adding unit located along the main pipe to add a gas to the beverage flowing along a second portion of the main pipe. The in-line cooling unit comprises a number of electric fans which, on command, circulate, inside a compartment of the in-line cooling unit, a stream of cold air at a temperature below a freezing temperature and/or a stream of hot air at a temperature above the freezing temperature. The fans are able to alternate and mix the two air streams to bring the liquid inside the tubular body to, and maintain it at, around the freezing temperature of water or other beverage. In particular, by controlling cold and/or hot air streams provided by cooling means the percentage of water in the solid or semisolid mixture state does not exceed a predetermined maximum threshold of the maximum capacity of the cooling unit.

A drawback with known prior art systems is for example that when frozen liquid is formed in a cooling unit, the ice that builds up is often not perfectly homogeneous, hence there is a risk that the cooling unit become obstructed. Another problem associated with prior art systems is to be able to offer variable temperature of the dispensed beverage. A further problem with in-line systems is to be able to carbonate the beverage in an efficient way. Even a further problem for some prior art systems is to detect a water level in a tank that supply beverage into the system.

Hence there is a need for an improved drink dispensing system.

BRIEF DESCRIPTION OF THE INVENTION

It is an object of the present invention to provide an improved in-line drink dispensing system designed to eliminate one or more of the aforementioned drawback and problems.

It is another object of the present invention to provide an in-line drink dispensing system which is simple.

It is yet another object of the present invention to provide an in-line drink dispensing system that minimizes manufacturing and service costs.

The above objects and others are achieved by the features outlined in the independent claims. Further advantageous embodiments are outlined in the dependent claims.

According to a first aspect of the invention the above objects and others are achieved by providing a drink dispensing system, comprising an inlet for receiving liquid from a liquid source, an outlet for dispensing controllable amounts of liquid, a pump being in liquid connection with the inlet and the outlet for regulating a flow of liquid, a control unit associated with the pump for controlling the pump, characterised by a measuring unit for determining a workload of the pump, whereby the control unit controls the pump based on the workload.

By measuring the workload and controlling the pump with a control unit as mentioned above it is possible to use the pump for different tasks, thereby a much simpler, less spacious and less complex system can be obtained.

The liquid can either be water or some other kind of beverage, therefore the liquid source could be either a separate tank or it could be mains for continuous supply of liquid.

Preferably the system according to the invention further comprises a cooling unit for cooling liquid, wherein the cooling unit is arranged upstream of the pump. Thereby it is ensured that liquid is supplied to the cooling unit when connected to a liquid source.

The invention may also comprise a bypass unit arranged such that at least a part of the flow of liquid can bypass the cooling unit. Thereby the pump can be used to control ice growth by circulating the liquid through the bypass. By using the pump and monitoring the workload on the pump it is possible to use less or even no additional sensors in the system. Furthermore it does not matter if the ice growth is homogeneous or not since the pump would sense an obstruction anywhere in the system that is in fluid connection with the pump. Thus based on the workload of the pump it is possible to determine if the cooling unit is about to get obstructed or blocked by ice. Depending on the workload either the pump can be operated to circulate the liquid, or the cooling can be turned off so that the ice growth stops and a free passage in the cooling unit can be ensured. The bypass unit may comprise a check valve so that the liquid can only flow in one particular direction.

The present invention may further comprise a gas supply unit for mixing the liquid with a gas, wherein the gas supply unit is arranged downstream of the pump. Since the gas supply unit is arranged downstream of the pump, the pump can be used to build up water pressure passing in the gas supply unit. Thereby the liquid can be mixed with the gas more efficiently.

The present invention may further comprise a user interface connectable to the control unit. Thereby a user can interact with the system either by inputting an instruction, or by looking at the user interface, obtain information about the system, and thereby being able to determine a status of the system. For example the user may select a temperature of the liquid that the system should dispense, or the interface may indicate that its reservoir needs to be refilled with for example liquid. The user interface can be a touch screen or a screen with additional buttons. The user interface may communicate to the user by using at least one of the following message carriers: color and/or text and/or sound and/or icon messages.

The pump is preferably a bidirectional pump, thereby the pump can be operated in a certain direction in order to perform a specific task. For example the pump may be reversed for performing a liquid level control check or for performing an ice control, or the pump may be run in the other direction in order to build up a pressure for carbonizing the liquid in the gas supply unit and/or for dispensing liquid and/or for controlling the temperature of the liquid to be dispensed.

According to a second aspect of the invention, the above objects and others are achieved by a refrigerator comprising a drink dispensing system according to the invention. By having such a refrigerator a less complex refrigerator is achieved with regards to for example number of parts and technical complexity. Furthermore it is easer to produce such a refrigerator since it would demand less production steps.

According to a third aspect of the invention, the above and other objects are achieved by a method for managing a dispensing system comprising the steps of: receiving liquid from a liquid source, regulating a flow of liquid with a pump, dispensing liquid via an outlet, characterized in that the method comprises the steps of: determining a value corresponding to a workload of the pump, and based on the value of the workload controlling the pump.

By determining a value corresponding to a workload of the pump and controlling the pump based thereon, it is possible to use the pump for different tasks, thereby a less complex and less spacious system can be obtained.

The method may further comprise the steps of receiving an input signal from a user interface and based on the input signal from the user interface controlling the pump. As mentioned above a user may input instructions via a user interface. For example these instructions can relate to temperature selection, carbonization and so forth.

The method may further comprise the step of running the pump at constant speed in order to stabilize the flow of the liquid created by the pump.

The pump may be operated at constant speed preferably during a time interval such as during a one second time interval or the alike. For example if the pump is operated at constant speed during this time period, a stable flow can be obtained and the measurement of the value of the workload becomes more accurate. The time interval can be longer, for example 2, 3 or 4 seconds, or shorter such as 0.8, 0.5 or 0.3 seconds depending on the situation.

Furthermore the method may comprise the step of determining the value corresponding to the workload of the pump at certain times during a time interval. Thereby a number of values can be extracted and based on the value an average of the workload can be calculated. The time intervals may have different lengths, hereby synchronization with external disturbance sources is avoided and improved results can be achieved.

Preferably the determination of the value is based on steps of calculating an average value based on one or more values corresponding to the workload of the pump. During the interval when the pump is operated at constant speed approximately 250 values are measured. Based on these 250 values an average is calculated.

Based on the average value, a starting point for the pump can be determined. By determining a time to start the pump or an idle time for the pump the ice growth can be controlled. This can be done since the calculated average is compared to predetermined measured values in a table, depending on which measured value in the table the calculated average corresponds to, a certain operation program for the pump is selected.

If the calculated average corresponds to the highest measured value in the table or if the calculated average is above a certain threshold value, the ice growth process is halted. This can be done by turning of the devices providing cold to the ice module, hence canceling the ice growth process.

According to a fourth aspect of the invention, the above objects and others are achieved by a control unit configured to perform the method according to the third aspect.

These and other aspects of the invention will be apparent from and elucidated with reference to the embodiments described hereinafter.

DESCRIPTION OF PREFERRED EMBODIMENTS

Figure 1:
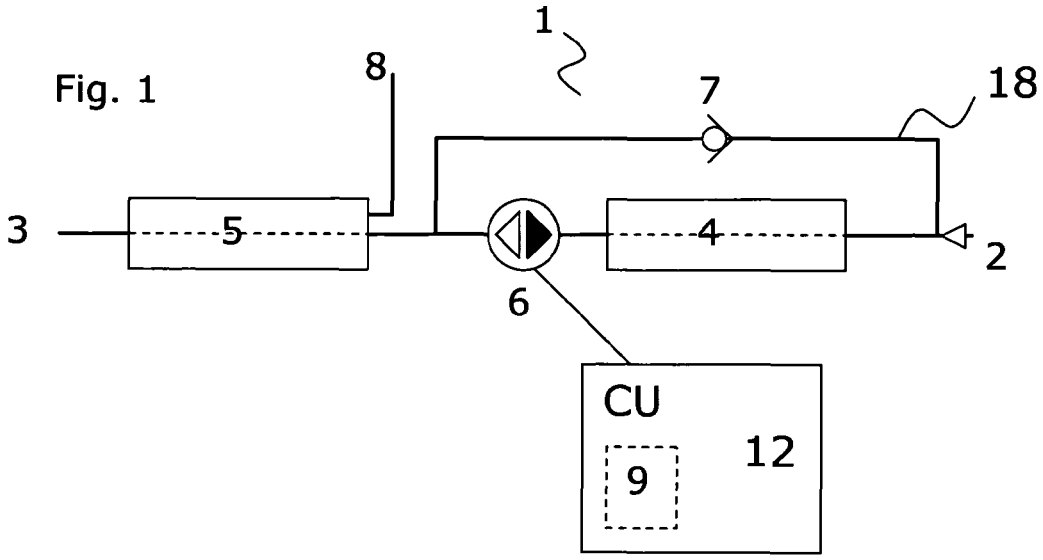
FIG. 1 illustrates an in-line drink dispensing system according to the invention

FIG. 1 illustrates a drink dispensing system 1 according to a first embodiment of the present invention. The system comprises an inlet 2 for receiving liquid. From the inlet 2, pipes are arranged for conveying the liquid in the system to the outlet 3. After the inlet 2, the pipe branches into two pipes, one of the pipes comprises a bypass unit 18 and the other pipe leads to the cooling unit 4. The bypass unit 18 comprises a check valve 7 in order to prevent liquid to flow in the wrong direction. The cooling unit 4 may be a cooling device, known to those skilled in the art, in which liquid can be chilled, stored, and dispensed at a later point in time. For example, the cooling unit 4 may comprise a number of electric fans which, on command, may circulate, inside a compartment of the cooling unit 4, a stream of cold air at a temperature below a freezing temperature and/or a stream of hot air at a temperature above the freezing temperature. After the cooling unit 4 the pump 6 is arranged. The pump is preferably a bi-directional pump that can pump the liquid in at least two directions. After the pump 6 the two pipes are merged into one pipe again. A gas supply unit 5 is coupled to the pipe after the merger of the two pipes. A gas supply pipe 8 may be coupled to one end of the gas supply unit 5 in order to provide gas into the gas supply unit 5. An outlet 3, for dispensing the liquid in to a container such as a glass, is coupled to the other end of the gas supply unit 5.

The flow of liquid in this system starts at the inlet 2 where, the liquid can either pass via the bypass unit 18 or it can pass via the cooling unit 4 and pump 6, or a part of the liquid flow can pass the bypass unit 18 and another part of the flow can pass via the cooling unit 4 and the pump 6. How the liquid flows is dependent on how the pump is controlled and operated. For example if a user activates the system in such a way that the pump 6 is not activated, the liquid will flow from the inlet 2 via the by pass unit 18 and gas supply unit 5 to the outlet 3. However if the user activates the system in such a way that the pump 6 is operated in full speed, the liquid will flow from the inlet 2 via the cooling unit 4, the pump 6 and via the gas supply unit 5 to the outlet 3. Hence if the user wants to have cool liquid the user can interact with a user interface 19 not illustrated in FIG. 1 so that the control unit 12 sends an activation signal to the pump 6. The pump 6 will then start and thereby control the flow of liquid so that the liquid passes the cooling unit 4 so that cool liquid is dispensed at the outlet 3. A user can also activate the system in such a way so that the pump 6 operates at a speed so that the liquid flows both ways, via the bypass unit 18 and via the cooling unit 4.

Figure 2:
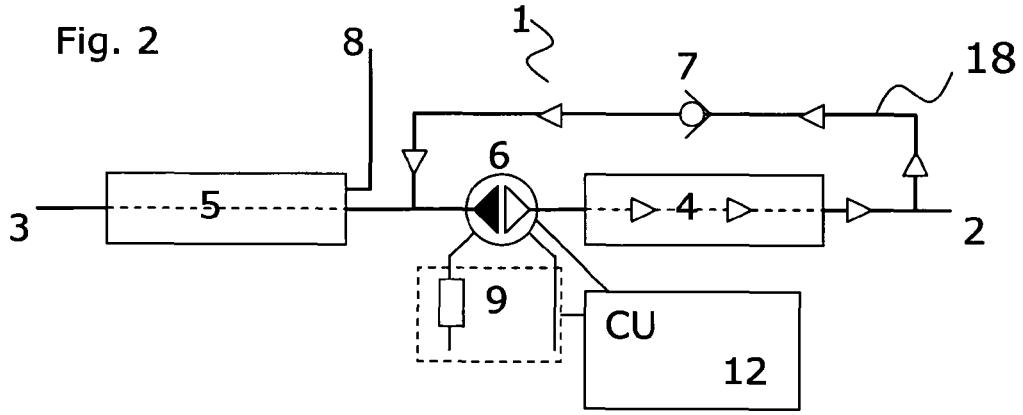
FIG. 2 illustrates an in-line drink dispensing system wherein the pump circulates liquid through the by-pass line and the cooling container.

FIG. 2 illustrates the system 1 according to the first embodiment when the system 1 is performing an ice control check. The flow of the liquid is indicated by the arrows. When the pump 6 perform an ice control the pump 6 reverses the flow of liquid so that the liquid flows from the pump 6 via the cooling unit 4 and via the bypass unit 18 back to the pump 6, thereby creating a circular flow. By doing this, a narrow passage or obstruction in the flow path can be identified. If the ice growth has created an obstruction or narrow passage the pump 6 have to work harder in order to force the liquid pass this passage. This causes an increase in the current used by the pump 6. By measuring how much current the pump 6 is using it is possible to detect how much ice that is present in the cooling unit 4. A measuring unit 9 is used to measure the current the pump 6 is using. The current through the pump 6 is measured as a voltage over a small resistor in series with the pump 6. Preferably the resistor is not too small but also not too large since there will be a voltage drop over this resistor giving less power to the pump 6. For example, the resistor is preferably between 0.1 ohm and 10 ohm depending on the size and electronic characteristics of the pump being employed. The operational direction of the pump 6 is illustrated with the black and white arrows in the figure.

Figure 3:
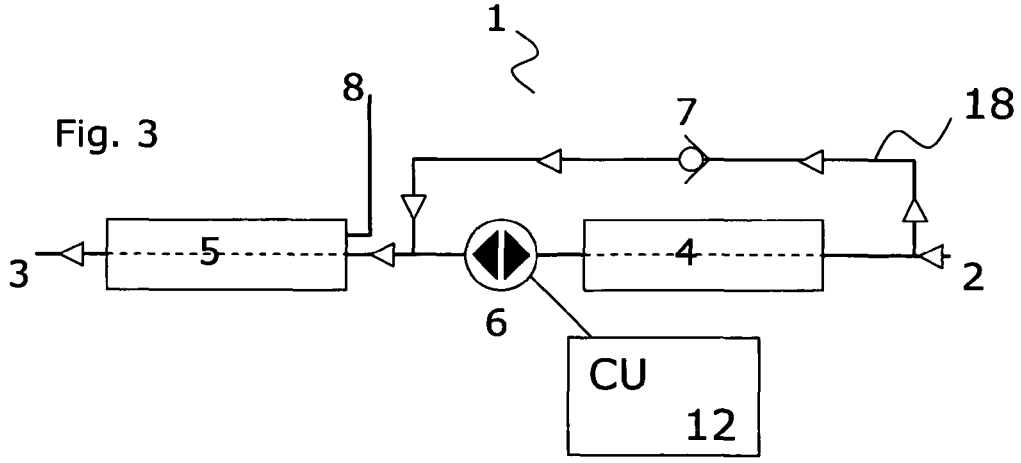
FIG. 3 illustrates an in-line drink dispensing system wherein the liquid bypasses the cooling unit.

FIG. 3 illustrates the system 1 according to the first embodiment when the system dispenses liquid which has not been cooled in the cooling unit 4. In this situation the pump 6 may work as a valve that shuts off the flow via the cooling unit 4 so that no liquid passes the cooling unit 4. Instead the flow of liquid passes the by pass unit 18 and then passes the gas supply unit 5 where it can be mixed with $CO_2$ before the liquid is dispensed in to a container, such as a glass or the alike, not illustrated in the figure.

Figure 4:
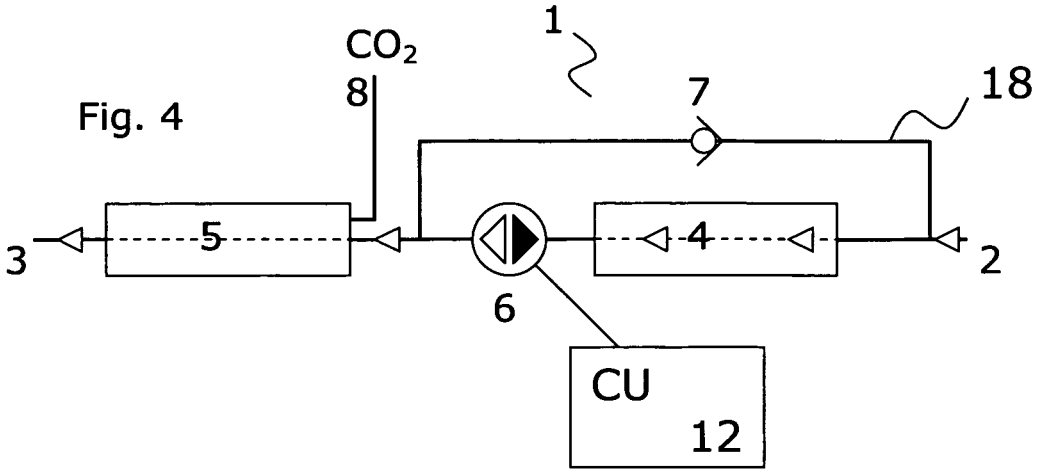
FIG. 4 illustrates an in-line drink dispensing system wherein $CO_2$ is added.

FIG. 4 illustrates the system 1 according to the first embodiment when the system dispenses carbonated liquid which is cooled. The pump 6 is now forcing the flow of liquid towards the outlet 3 via the cooling unit 4 and gas supply unit 5 as indicated by the white arrows. An increase of the pressure is created after the pump 6 so that the liquid can be more efficiently mixed with gas such as $CO_2$. The check valve 7 also stops the flow from taking the wrong direction.

Figure 5:
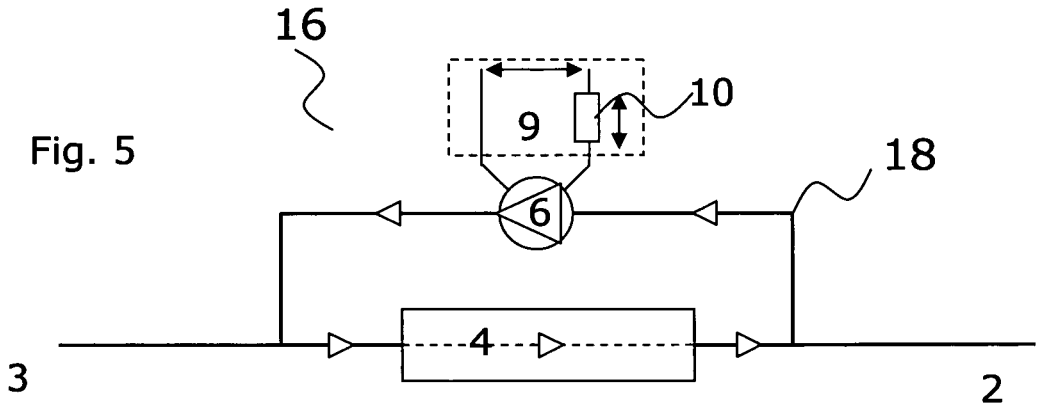
FIG. 5 illustrates a part of an in-line drink dispensing system wherein the pump is arranged in the bypass unit.

FIG. 5 illustrates a variation of the present invention wherein the system 16 comprises a cooling unit 4, a bypass unit 18 and a pump 6 wherein the pump 6 is arranged in the bypass unit 18. This embodiment may comprise one or more valves in order to control the flow so that a circular flow can be achieved. A measuring unit 9 comprising a resistance 10 is coupled to the pump. The flow in the system 16 is illustrated by the white arrows which indicate a circular flow which is used for ice control. Liquid is provided via the inlet 2 and a valve may be arranged at the outlet 3 in order to close or open the outlet 3 so that liquid can be dispensed. When the valve is open the liquid will flow from the inlet 2 to the outlet 3 via the cooling unit 4. Since the inlet is pressurized and the pump 6 is not operating the pressure will create the flow through the system 16 when the outlet 3 is open.

Figure 6:
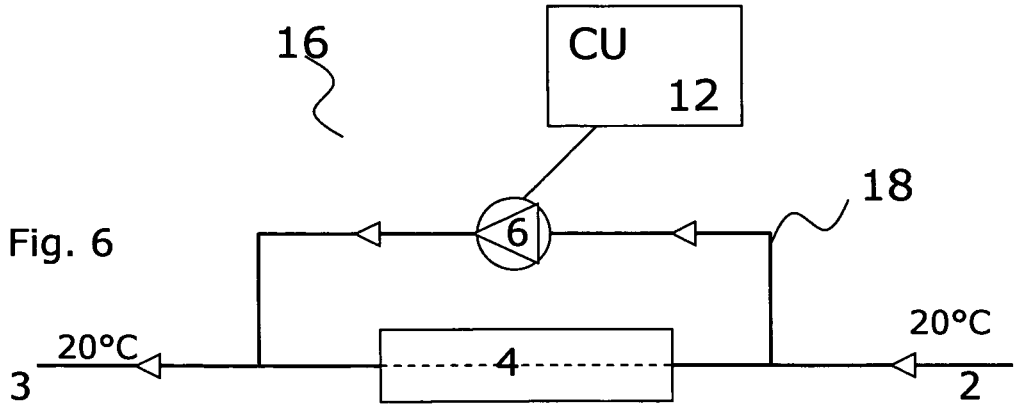
FIG. 6 to FIG. 8 illustrate a part of an in-line drink dispenser for controlling the temperature of the dispensed liquid.

FIG. 6 illustrates the system 16 in FIG. 5 wherein the system is dispensing room tempered liquid, for instance at 20° C. When the pump 6 is operating the flow will instead flow via the bypass unit 18 and the pump 6 so that room tempered liquid is dispensed. Due to the cooling module 4 constitutes a resistance with regards to the flow and since the pump 6 is operating most of the liquid will bypass the cooling unit 4.

Figure 7:
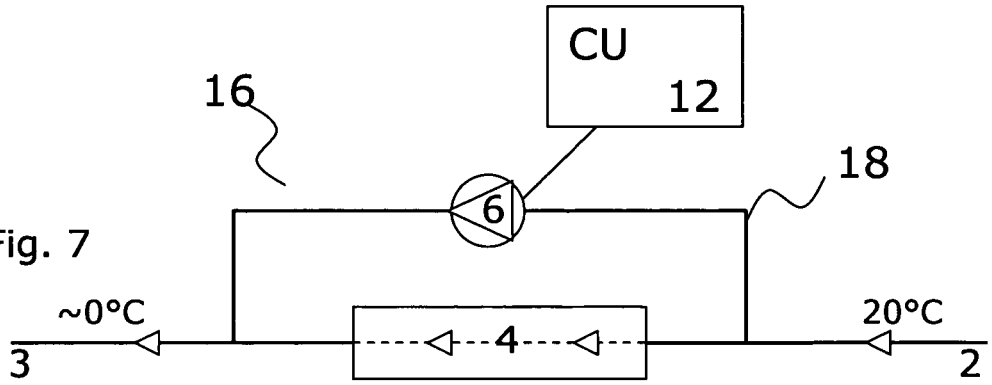

FIG. 7 illustrates the system 16 in FIG. 5 and FIG. 6 wherein the system 16 is dispensing liquid that is cooled by the cooling module to just above 0° C. This can be achieved by controlling the system 16 so that the whole flow of the liquid passes via the cooling unit 4. Preferably the pump 6 is turned off and therefore works as a valve so that the whole flow have to take the other way via the cooling unit 4. The pressure from the liquid source attached to the inlet 2 creates a pressure in the system so that the liquid flows from the inlet 2 to the outlet 3, when the outlet is open.

Figure 8:
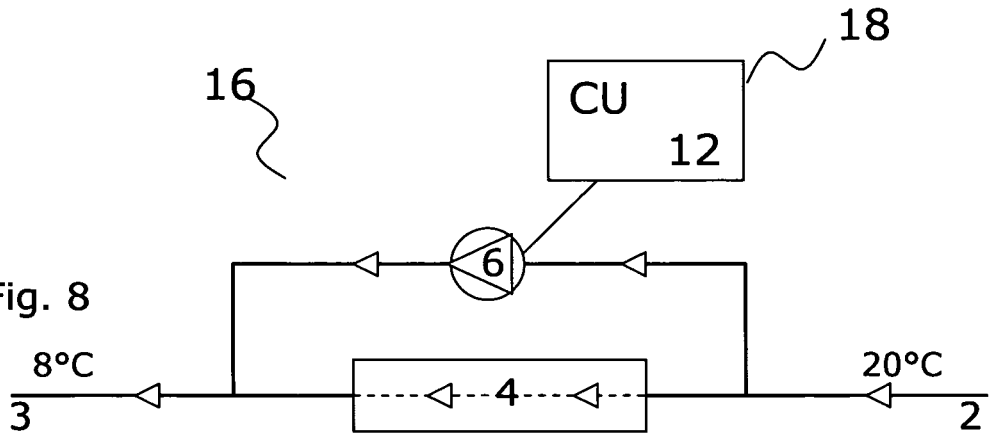

FIG. 8 illustrates the system 16 similar to FIG. 5-7 wherein the system is dispensing liquid having a temperature somewhere between room temperature and 0° C., for example between 20° C. and 0° C. In this particular example illustrated in FIG. 8 the temperature of the dispensed liquid is 8° C. This is achieved by operating the pump 6 at a certain speed. The speed may be controlled by feeding the pump 6 with pulses of current or varying the voltage over the pump. Thereby a flow is present in both the cooling unit 4 and the bypass unit 18 so that two liquid flows is created before the cooling unit 4 and mixed after the cooling unit 4, when they have two different temperatures. Thereby the temperature can be controlled depending on the mix of these two flows. By changing the length of the electric pulses providing electricity to the pump 6, the speed of the pump 6 can be controlled. Longer pulses results in higher speed and shorter pulses results in lower speed. In this way it is possible to dispense liquid having a temperature between 0° C. and 20° C. If the pump 6 is running at full speed the temperature is about 20° C. If the pump 6 is totally shut off so it acts like a closed valve, the temperature of the dispensed liquid could be approaching 0° C., since all the liquid will go through the cooling unit 4. Of course the highest and lowest temperature is dependent on the temperature in the surroundings or on the temperature of the liquid that enters the system at the inlet 2, as well as the performance and capacity of the cooling unit.

Figure 9:
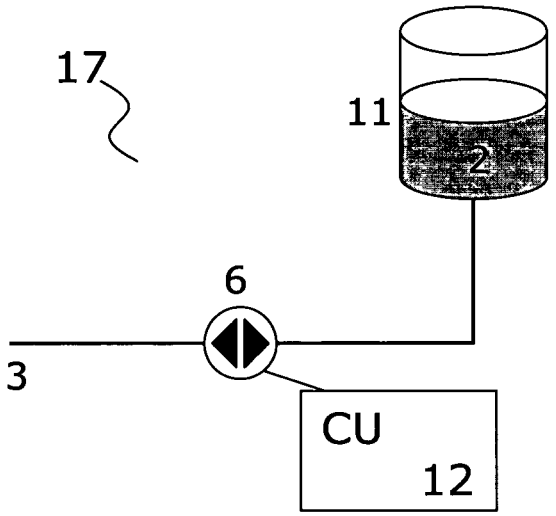
FIG. 9 illustrates a drink dispenser coupled to a reservoir.

FIG. 9 illustrates a dispensing system 17 according to a second embodiment which is coupled to a reservoir 11 for supplying liquid into the system via the inlet 2. The system further comprises a pump 6 a control unit 12 and an outlet 3 for dispensing liquid. The pump is arranged in between the inlet 2 and reservoir 11 and the outlet 3 so that the operation of the pump 6 influences the flow of liquid in the system 17. In this arrangement the pump can be reversed so that the flow of liquid is reversed into the reservoir 11 via the inlet 2. During this operation the current of the pump 6 can be measured and based on the measured value the amount of liquid present in the reservoir 11 can be identified. In this way it is possible to keep track of when the reservoir 11 is full, half full or when the reservoir 11 is close to empty or empty. Depending on how much liquid that is left in the reservoir 11 this causes a resistance for the pump 6. It is the height of the water pillar that causes the resistance for the pump. The height of the water pillar is the horizontal distance between the inlet of the pump 6 and the surface of the liquid in the reservoir 11.

Figure 10:
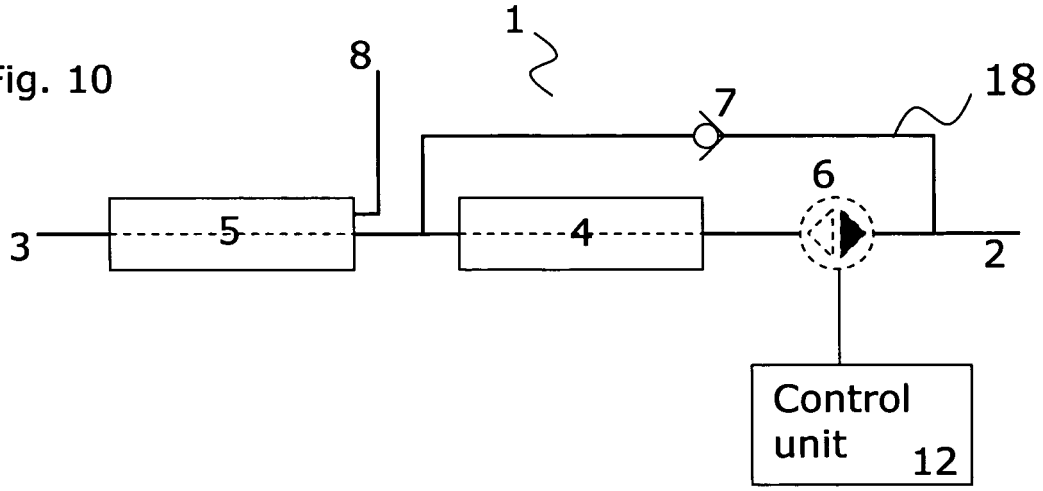
FIG. 10 illustrates an alternative arrangement of the pump.

FIG. 10 illustrates a variation of the present invention according to the system as illustrated in FIGS. 1-4. According to this variation the pump 6 has a different location. In this embodiment the pump 6 is arranged after the junction, where the pipe has branched up after the inlet 2, into one pipe for the bypass unit 18 and one pipe for the cooling unit 4, but before the cooling unit 4. It is also possible to achieve a circular flow by having the pump 6 in this location in order to control the ice in the cooling unit 4.

Figure 11:
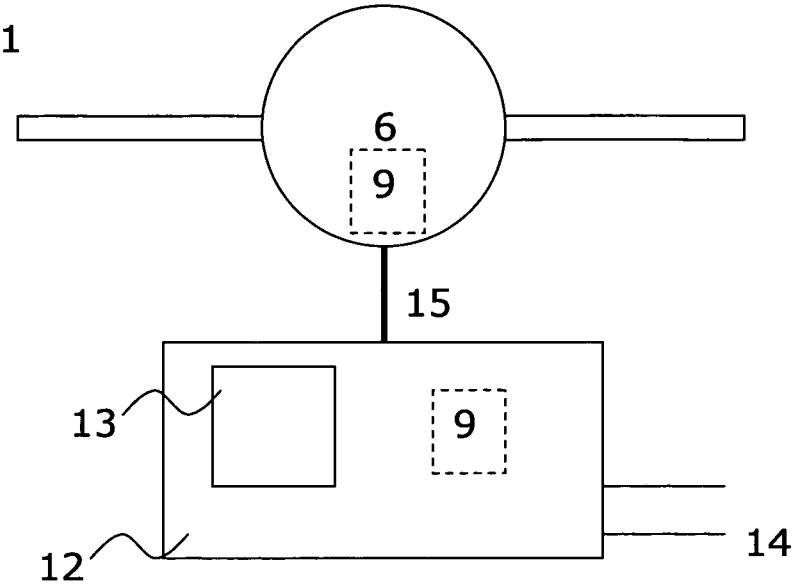
FIG. 11 illustrates a pump connected to a control unit.

FIG. 11 illustrates an arrangement of the pump 6 and control unit 12. The pump 6 may comprise a measuring unit 9 for measuring a current of the pump 6 when the pump 6 is operating. The pump 6 is connected to the control unit 12 either by wire 15 or wireless communication technology such as Bluetooth or infrared technology, so that the signals from the measuring unit 9 can be transferred to and analyzed by the control unit 12. An alternative arrangement of the measuring unit 9 is in the control unit 12 which is illustrated in that the measuring unit 9 is illustrated with dotted lines. The measuring unit 9 comprises a microprocessor for analyzing the input received from the pump 6 and/or measuring unit 9. As mentioned earlier the speed of the pump 6 is controlled by pulsing feed voltage to the pump, or varying the voltage.

When the system is about to measure the workload of the pump 6, preferably three operating phases during which the pump may be operated differently, could be executed. The actual measurements are conducted in the last of these three phases as will be described below.

Phase 1

To lower the sound coming from the pump a ramp-up sequence may be used where first a series of short pulses is fed to the pump followed by a sequence of longer pulses. At the end the pump is fed continuously driving it at full speed. This phase takes approximately 0.5 seconds.

Phase 2

The pump is running at full speed for approximately 1 second, in order to stabilize the circulation flow.

Phase 3

In this phase approximately 250 values are measured of the current provided to the pump 6 and an average value is calculated. This is done to filter out disturbances on the signal. Also the time distance between each sample is changed to avoid synchronizing with any external disturbance source. The calculated value is preferably used to control two things, the distance between each check and finally if the ice growth process should be aborted.

| Read | Value | Action | Idle time (s) |
|---|---|---|---|
| < | 180 | Run | 300 |
| < | 190 | Run | 200 |
| < | 194 | Run | 120 |
| < | 196 | Run | 80 |
| < | 198 | Run | 60 |
| < | 200 | Run | 40 |
| < | 202 | Run | 20 |
| >= | 204 | Stop | 1800 |

It is not always necessary to run through all the three phases, any combination of them could be used or only one of them.

Figure 12:
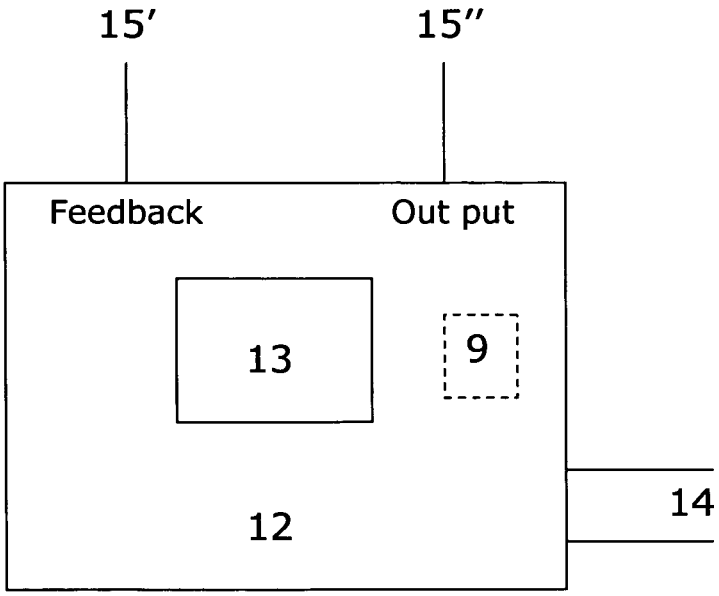
FIG. 12 illustrates a control unit.

FIG. 12 illustrates the control unit 12 comprising the micro processor 13 and the measuring unit 9. Furthermore the wire 15 can be divided into two wires, one for receiving an input or "feedback" from the pump and one for outputting a signal to the pump 6 thereby the operation of the pump 6 can be controlled. The control unit 12 is coupled to an electric source for supply of electricity via wires 14.

Figure 13:
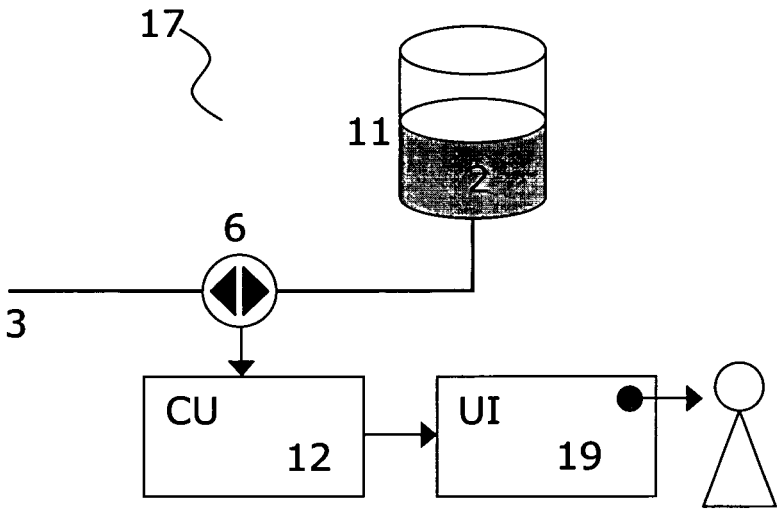
FIG. 13 illustrates a dispensing system comprising a pump, control unit and user interface.

FIG. 13 illustrates a dispensing system according to the second embodiment comprising a reservoir 11, wherein the system comprises a user interface 19 for interaction with a user. For this specific embodiment the control unit 12 may reverse the pump 6 and measure the current and based on that value calculate how much liquid that is left in the reservoir 11. If the reservoir is empty or nearly empty the control unit can send a signal to the user interface that light up a warning light such as a LED, or activates a warning signal, in order to indicate to the user that the reservoir 11 needs to be refilled.

Figure 14:
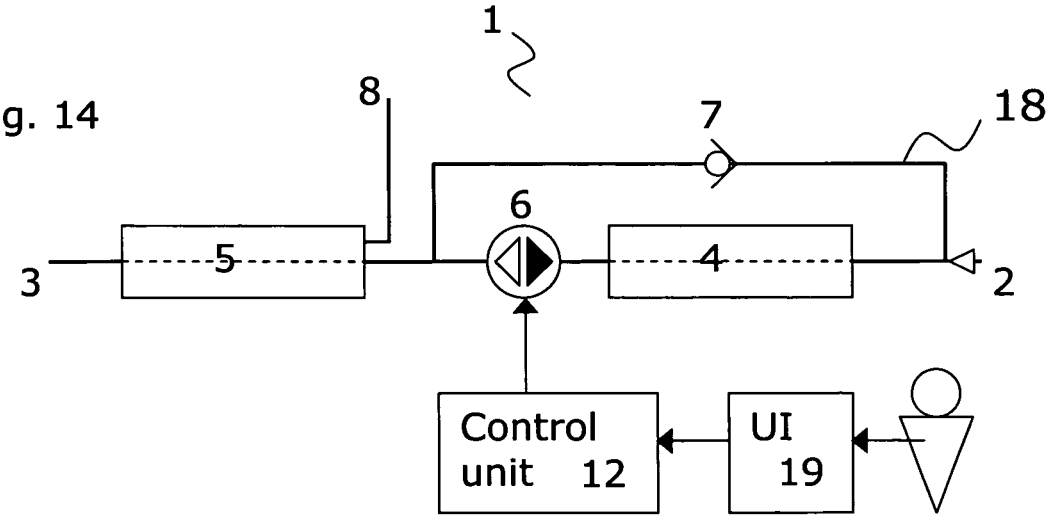
FIG. 14 illustrates an in-line drink dispensing system comprising a control unit and user interface.

FIG. 14 illustrates the dispensing system according to the first embodiment further comprising a user interface 19. A user can via this user interface 19 interact with the dispensing system and select if for example he/she wants to have cold and carbonated water, or only cold water, or room tempered carbonated water and so forth.

Figure 15:
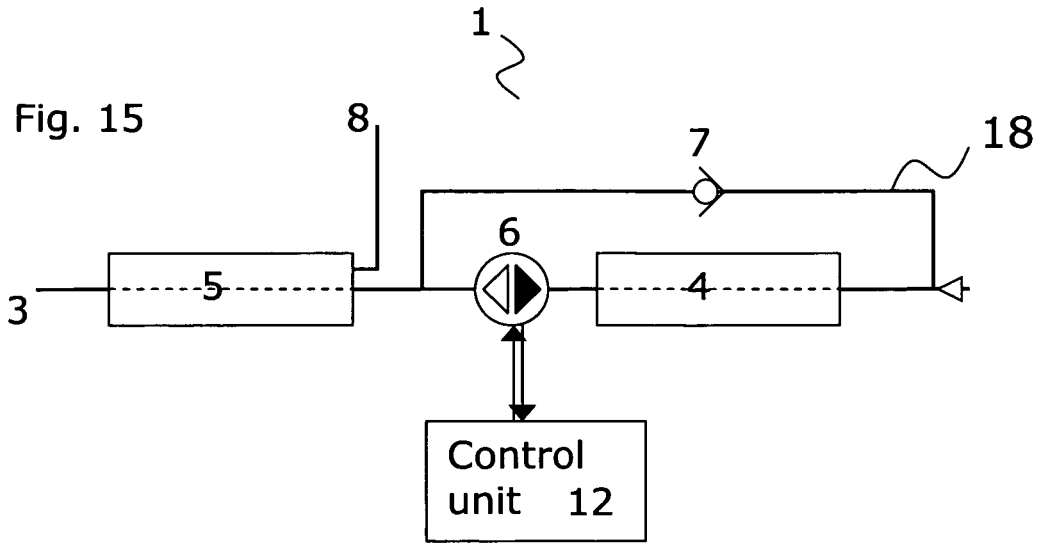
FIG. 15 illustrates signals between a pump and control unit in an in-line drink dispensing system.

FIG. 15 illustrates a variation of the dispensing system according to the first embodiment wherein the control unit 12 is communicating and operating the pump 6 without input from a user, for example for ice control in the system. By running the pump 6 the liquid is circulated in the pipe via the bypass unit 18 and cooling unit 4. When ice start to build, the load on the pump 6 increase. By measuring the current through the pump 6 this change of load can be measured.

Figure 16:
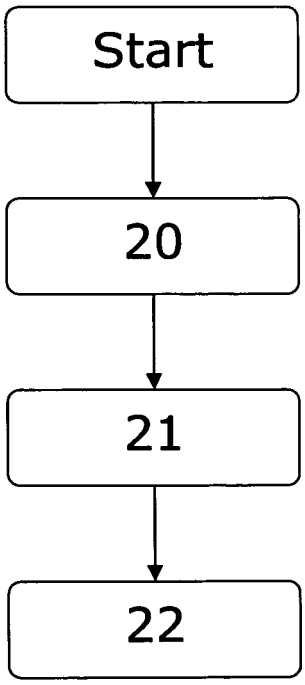
FIG. 16 illustrates a method for controlling an in-line drink dispensing system.

FIG. 16 illustrates a method for managing a dispensing system according to the invention. In step 20 the system receives liquid from a liquid source and in step 21 the method regulates the flow by use of a pump and then in step 22 determining a value corresponding to a workload of the pump 6 and based on the value of the workload controlling the pump 6.

Figure 17:
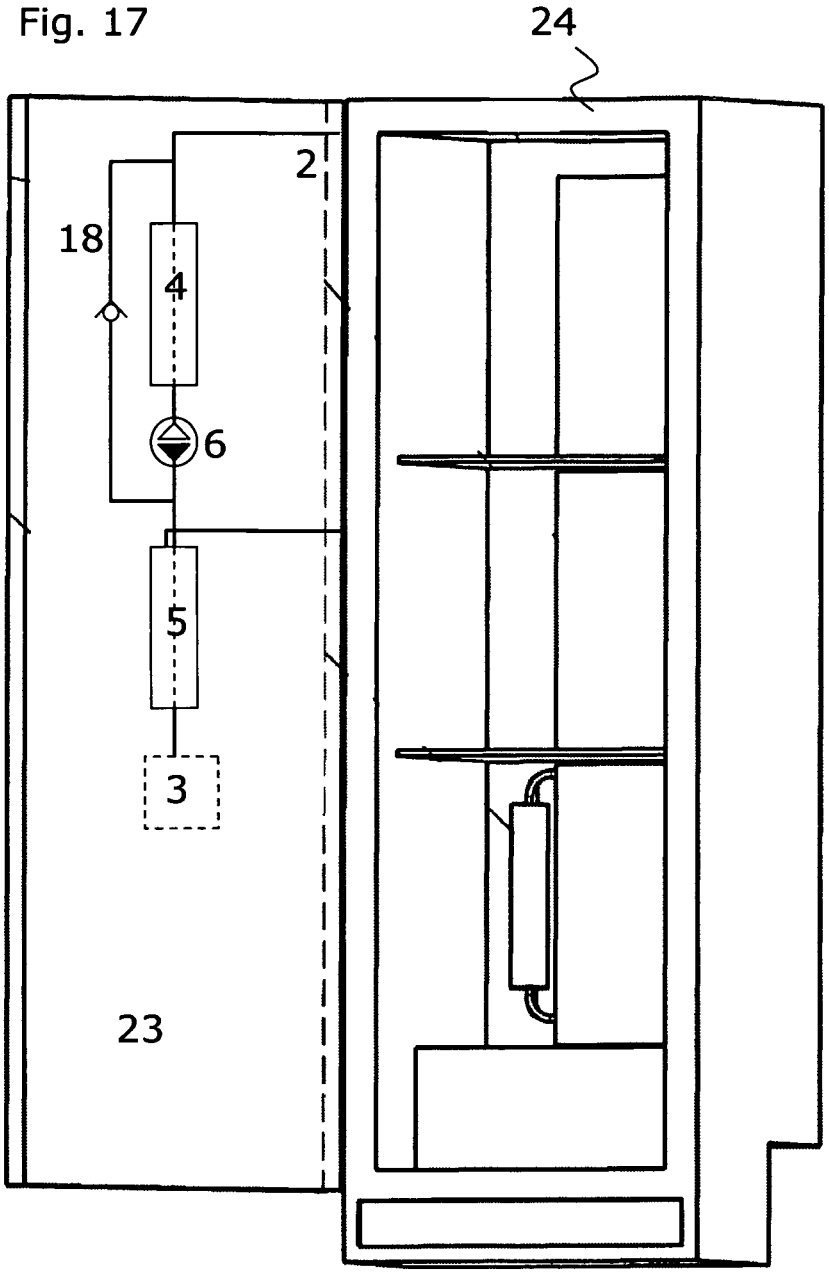
FIG. 17 illustrates a refrigerator comprising a dispensing system according to the invention.

FIG. 17 illustrates a refrigerator comprising an in-line drink dispensing system according to the present invention. In the figure the system is mounted in the door 23, however the different parts of the system can be arranged in different parts of the cabinet 24 and connected by pipes. Thereby it is possible to arrange the pump 6, the cooling unit 4, the gas supply unit 5 and bypass unit in different locations. The user interface is preferably mounted so that it is accessible on the outside of the door 23.

In the above description the term "comprising" does not exclude other elements or steps and "a" or "an" does not exclude a plurality.

The invention claimed is:

1. A drink dispensing system (1, 16, 17), comprising:
an inlet (2) for receiving liquid from a liquid source,
an outlet (3) for dispensing controllable amounts of liquid,
a pump (6) for regulating a flow of the liquid, said pump (6) being in fluid connection with the inlet (2) and the outlet (3),
a controller determining a workload of the pump by measuring a current used by the pump during operation of the pump (6) at constant speed and by calculating an average value of the current used by the pump, whereby the controller controls the pump (6) based on the determined workload.

2. A drink dispensing system (1, 16, 17) according to claim 1, further comprising a cooling unit (4) for cooling liquid, wherein the cooling unit (4) is arranged upstream of the pump (6).

3. A drink dispensing system (1, 16, 17) according to claim 2, further comprising a bypass unit (18) arranged such that at least a part of the flow of liquid can bypass the cooling unit (4).

4. A drink dispensing system (1, 16, 17) according to claim 3, wherein the bypass unit (18) comprises a check valve (7).

5. A drink dispensing system (1, 16, 17) according to claim 1, further comprising a gas supply (5) for mixing the liquid with a gas, wherein the gas supply (5) is arranged downstream of the pump (6).

6. A drink dispensing system (1, 16, 17) according to claim 1, further comprising a user interface (19) connectable to the controller.

7. A drink dispensing system (1, 16, 17) according to claim 1, wherein the pump (6) is a bidirectional pump.

8. A refrigerator comprising a dispensing system (1, 16, 17) according to claim 1.

9. A method for managing a dispensing system comprising the steps of:
receiving liquid from a liquid source,
regulating a flow of liquid with a pump (6),
dispensing liquid via an outlet (3),
determining a value corresponding to a workload of the pump (6) by measuring a current used by the pump during operation of the pump (6) at constant speed and by calculating an average value of the current used by the pump,
and
controlling the pump (6) based on the value corresponding to the workload.

10. A method according to claim 9, further comprising the steps of receiving an input signal from a user interface (19) and based on the input signal from the user interface (19) controlling the pump (6).

11. A method according to claim 9, wherein the step of determining the value corresponding to the workload of the pump (6) is performed at certain times during each of two or more time intervals having different durations.

12. A method according to claim 9, further comprising the step of, based on the value corresponding to the workload of the pump (6), determining a time to start the pump (6).

13. A computer implemented method according to claim 9, further comprising the steps of, based on the value corresponding to the workload of the pump (6), halting an ice growth process.

14. A controller configured to cause the dispensing system to perform the method according to claim 9.

15. A drink dispensing system according to claim 1, further comprising a cooling unit (4) for cooling liquid, wherein the cooling unit (4) is arranged upstream of the pump (6) and a bypass unit (18) arranged such that at least a part of the flow of liquid can bypass the cooling unit (4), wherein the pump (6) regulates the flow of the liquid flowing through one of the bypass unit (18) and the cooling unit (4), or partly through the bypass unit (18) and partly through the cooling unit (4).

16. A drink dispensing system (1, 16, 17), comprising:
an inlet (2) for receiving liquid from a liquid source,
an outlet (3) for dispensing controllable amounts of liquid,
a pump (6) configured as a sensor for regulating a flow of the liquid, said pump (6) being in fluid connection with the inlet (2) and the outlet (3),
a controller measuring a current used by the pump during operation of the pump (6) at constant speed and by calculating an average value of the current used by the pump, whereby the controller controls the flow of the liquid through the pump (6) based on the average value of the current.

17. A method for managing a dispensing system according to claim 9, further comprising the step of redirecting the flow of the liquid through one of a bypass unit (18), a cooling unit (4), and or partly through the bypass unit (18) and partly through the cooling unit (4) when the value corresponding to the workload of the pump (6) exceeds a predetermined threshold value.

* * * * *